US009926865B2

(12) United States Patent
Kuwabara et al.

(10) Patent No.: US 9,926,865 B2
(45) Date of Patent: Mar. 27, 2018

(54) EVAPORATED FUEL PROCESSING APPARATUS

(71) Applicant: FUJI JUKOGYO KABUSHIKI KAISHA, Tokyo (JP)

(72) Inventors: Kosuke Kuwabara, Tokyo (JP); Kengo Ito, Tokyo (JP); Kazuya Okazaki, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 15/185,111

(22) Filed: Jun. 17, 2016

(65) Prior Publication Data

US 2016/0377003 A1 Dec. 29, 2016

(30) Foreign Application Priority Data

Jun. 26, 2015 (JP) ..... 2015-128876

(51) Int. Cl.
*F02D 41/00* (2006.01)
*F02D 41/14* (2006.01)
*F02M 25/08* (2006.01)

(52) U.S. Cl.
CPC ..... *F02D 41/004* (2013.01); *F02D 41/003* (2013.01); *F02D 41/0032* (2013.01);
(Continued)

(58) Field of Classification Search
CPC .. F02D 41/003; F02D 41/0032; F02D 41/004; F02D 41/0045; F02D 41/1456;
(Continued)

(56) References Cited

U.S. PATENT DOCUMENTS 5,758,631 A * 6/1998 Teraoka ..... F02D 41/0045 123/674
6,240,908 B1 * 6/2001 Hyodo ..... F02M 25/0809 123/198 D (Continued)

FOREIGN PATENT DOCUMENTS

JP H06-185418 7/1994
JP 2005-307919 11/2005

(Continued)

OTHER PUBLICATIONS

Office Action dated Jan. 31, 2017 for JP Patent Application No. 2015-128876 (Japanese with English translation, 6 pages).

*Primary Examiner* — John Kwon
*Assistant Examiner* — Johnny H Hoang
(74) *Attorney, Agent, or Firm* — Smith, Gambrell & Russell, LLP.

(57) ABSTRACT

An evaporated fuel processing apparatus includes: a fuel tank that stores fuel supplied to an engine; a purge pipe that communicates an upper space in the fuel tank with an inlet system of the engine; an electromagnetic valve that is mounted on the purge pipe and that opens and closes the purge pipe; an air-fuel ratio detecting module for detecting an air-fuel ratio of an air-fuel mixture burned in the engine in accordance with an oxygen concentration in exhaust gas emitted from the engine; and a controlling module for controlling open and close of the electromagnetic valve based on an operating state of the engine. The controller controls at least one of a valve-open cycle, a valve-open period, and a valve-open amount of the electromagnetic valve based on a variation value of the air-fuel ratio detected by the air-fuel ratio detecting module when opening the electromagnetic valve.

14 Claims, 4 Drawing Sheets

(52) U.S. Cl.
CPC ..... *F02D 41/0045* (2013.01); *F02D 41/1456* (2013.01); *F02M 25/089* (2013.01); *F02M 25/0836* (2013.01); *F02M 25/0854* (2013.01); *F02M 25/0872* (2013.01); *F02D 2200/0406* (2013.01); *F02D 2200/0602* (2013.01); *F02M 2025/0845* (2013.01)

(58) Field of Classification Search
CPC .... F02D 2200/0406; F02D 2200/0602; F02M 25/0836; F02M 25/0854; F02M 25/0872; F02M 25/089; F02M 2025/0845
USPC ..... 701/103, 104; 123/516, 518–521, 456
See application file for complete search history.

(56) References Cited

U.S. PATENT DOCUMENTS

| | | | | |
|---|---|---|---|---|
| 6,338,336 | B1 * | 1/2002 | Iida | F02D 41/0042 123/520 |
| 7,032,580 | B2 * | 4/2006 | Suzuki | F02D 41/0042 123/520 |
| 2003/0140901 | A1 * | 7/2003 | Amano | F02M 25/08 123/520 |
| 2005/0235969 | A1 | 10/2005 | Suzuki | |
| 2007/0119423 | A1 * | 5/2007 | Kano | F02D 41/0045 123/459 |
| 2014/0102420 | A1 | 4/2014 | Kimoto et al. | |

FOREIGN PATENT DOCUMENTS

| | | |
|---|---|---|
| JP | 2013-194602 | 9/2013 |
| JP | 2014-077422 | 5/2014 |
| JP | 2014-190241 | 10/2014 |

* cited by examiner

EVAPORATED FUEL PROCESSING APPARATUS

CROSS-REFERENCE TO RELATED APPLICATIONS

The present application claims priority from Japanese Patent Application No. 2015-128876 filed on Jun. 26, 2015, the entire contents of which are hereby incorporated by reference.

BACKGROUND

1. Technical Field

The present invention relates to an evaporated fuel processing apparatus that processes evaporated fuel generated in a fuel tank by causing an engine to suck the evaporated fuel through an inlet system for combustion.

2. Related Art

An evaporated fuel processing apparatus or an evaporated fuel purging system that processes evaporated fuel generated in a fuel tank is widely used in the related art in order to prevent the evaporated fuel from being discharged into an environment (atmosphere). The evaporated fuel processing apparatus processes the evaporated fuel by causing the evaporated fuel to be temporarily adsorbed on an adsorptive agent in a canister, causing an engine to suck the adsorbed evaporated fuel through an inlet system of the engine for combustion under predetermined operating conditions.

In recent years, an HEV (Hybrid Electric Vehicle) provided with an engine and an electric motor as drive power sources is widely used to improve a fuel consumption rate (fuel cost). Simultaneously, a PHEV (Plug-in Hybrid Electric Vehicle) that achieves a further improvement in terms of the fuel cost by mounting an increased amount of secondary battery, enabling charging of the secondary battery from outside, and extending a range of travelling as an electric vehicle compared with the HEV is now in practical use.

In the HEV and the PHEV (specifically the PHEV), the engine is stopped for a long time, and thus the frequency of a purge of evaporated fuel adsorbed on the canister is reduced. Therefore, discharge of excessive evaporated fuel which cannot be adsorbed by the canister into an environment, or an increase in size of the canister may be required. Accordingly, a so-called direct purge system is proposed. The direct purge system processes evaporated fuel by trapping the evaporated fuel in a sealed fuel tank instead of adsorbing in the canister and sucking the trapped evaporated fuel directly into the engine through an inlet system under predetermined operating conditions. However, a state in which a pressure in the fuel tank is kept at a high pressure for a long time due to accumulated evaporated fuel in the sealed fuel tank is not preferable, for example, in terms of durability of the sealed fuel tank.

Japanese Unexamined Patent Application Publication (JP-A) No. 2014-190241 discloses an evaporated fuel processing apparatus capable of reducing a pressure in a fuel tank. More specifically, the evaporated fuel processing apparatus disclosed in JP-A No. 2014-190241 opens a sealing valve that seals a communicating path between the interior of the fuel tank and a canister under the conditions that a purge operation for sucking the evaporated fuel from the canister into an intake pipe of the engine is executed and the pressure in the fuel tank is relatively high. At that time, the evaporated fuel processing apparatus controls an opening-closing period of the sealing valve such that an open period of the sealing valve is shorter in a state in which the pressure in the fuel tank is high than in a state in which the pressure in the fuel tank is low.

As described above, since keeping the pressure in the fuel tank at a high pressure for a long time is not preferable in terms of the durability of the fuel tank, there is a desire to reduce the pressure in the fuel tank in an as early stage as possible. However, with the evaporated fuel processing apparatus of the related art, if an attempt is made to increase an amount of the evaporated fuel to be sucked by the engine for reducing the pressure in the fuel tank in the early stage, an air-fuel ratio (A/F) of an air-fuel mixture which burns in the engine may vary, and deterioration in emission may result.

SUMMARY OF THE INVENTION

It is desirable to provide an evaporated fuel processing apparatus that processes evaporated fuel in an interior of a fuel tank by causing an engine to suck the evaporated fuel directly for combustion, in which a pressure in the interior of the fuel tank may be reduced in an earlier stage while reducing variations in an air-fuel ratio of an air-fuel mixture.

An evaporated fuel processing apparatus according to an aspect of the present invention includes a fuel tank that stores fuel supplied to an engine; a purge pipe that communicates an upper space in an interior of the fuel tank with an inlet system of the engine, an electromagnetic valve that is mounted on the purge pipe and that opens and closes the purge pipe, an air-fuel ratio detecting module for detecting the air-fuel ratio of an air-fuel mixture burned in the engine in accordance with an oxygen concentration in exhaust gas emitted from the engine, and a controlling module for controlling open and close of the electromagnetic valve based on an operating state the engine, in which the controlling module controls at least one of a valve-open cycle, a valve-open period, and a valve-open amount of the electromagnetic valve based on a variation value of the air-fuel ratio detected by the air-fuel ratio detecting when opening the electromagnetic valve.

The controlling module may prohibit the electromagnetic valve from opening when the variation value of the air-fuel ratio is not lower than a first predetermined value.

In the case where the variation value of the air-fuel ratio is lower than the first predetermined value, the controlling module may shorten the valve-open cycle of the electromagnetic valve compared with the case where the variation value of the air-fuel ratio is not lower than the first predetermined value.

The evaporated fuel processing apparatus may further include a tank internal pressure detecting module for detecting the pressure in the fuel tank. The controlling module may determine the valve-open period of the electromagnetic valve based on the pressure in the fuel tank detected by the tank internal pressure detecting module and a flow rate of the evaporated fuel flowing in the purge pipe.

The evaporated fuel processing apparatus may include a canister provided on the purge pipe on a downstream side of the electromagnetic valve and capable of adsorbing the evaporated fuel, and a purge solenoid valve that is mounted on the purge pipe on a downstream side of the canister and that opens and closes the purge pipe. The controlling module may prohibit the electromagnetic valve from opening in the case where the purge solenoid valve is closed.

The controlling module may prohibit the electromagnetic valve from opening when the pressure in the fuel tank is lower than the first predetermined value.

The controlling module may prohibit the electromagnetic valve from opening when a variation value of the pressure in the fuel tank is not lower than a second predetermined value.

The evaporated fuel processing apparatus may further include a concentration detecting unit that detects concentration of the evaporated fuel in the fuel tank. The controlling module may regulate at least one of the valve-open cycle, the valve-open period, and the valve-open amount of the electromagnetic valve considering the concentration of the evaporated fuel detected by the concentration detecting unit.

An evaporated fuel processing apparatus according to another aspect of the invention includes a fuel tank that stores fuel supplied to an engine; a purge pipe that communicates an upper space in the fuel tank with an inlet system of the engine; an electromagnetic valve that is mounted on the purge pipe and that opens and closes the purge pipe; an air-fuel ratio detector configured to detect an air-fuel ratio of an air-fuel mixture burned in the engine in accordance with an oxygen concentration in exhaust gas emitted from the engine; and circuitry configured to control open and close of the electromagnetic valve based on an operating state of the engine, in which the circuitry controls at least one of a valve-open cycle, a valve-open period, and a valve-open amount of the electromagnetic valve based on a variation value of the air-fuel ratio detected by the air-fuel ratio detector when opening the electromagnetic valve.

DETAILED DESCRIPTION

Figure 1:
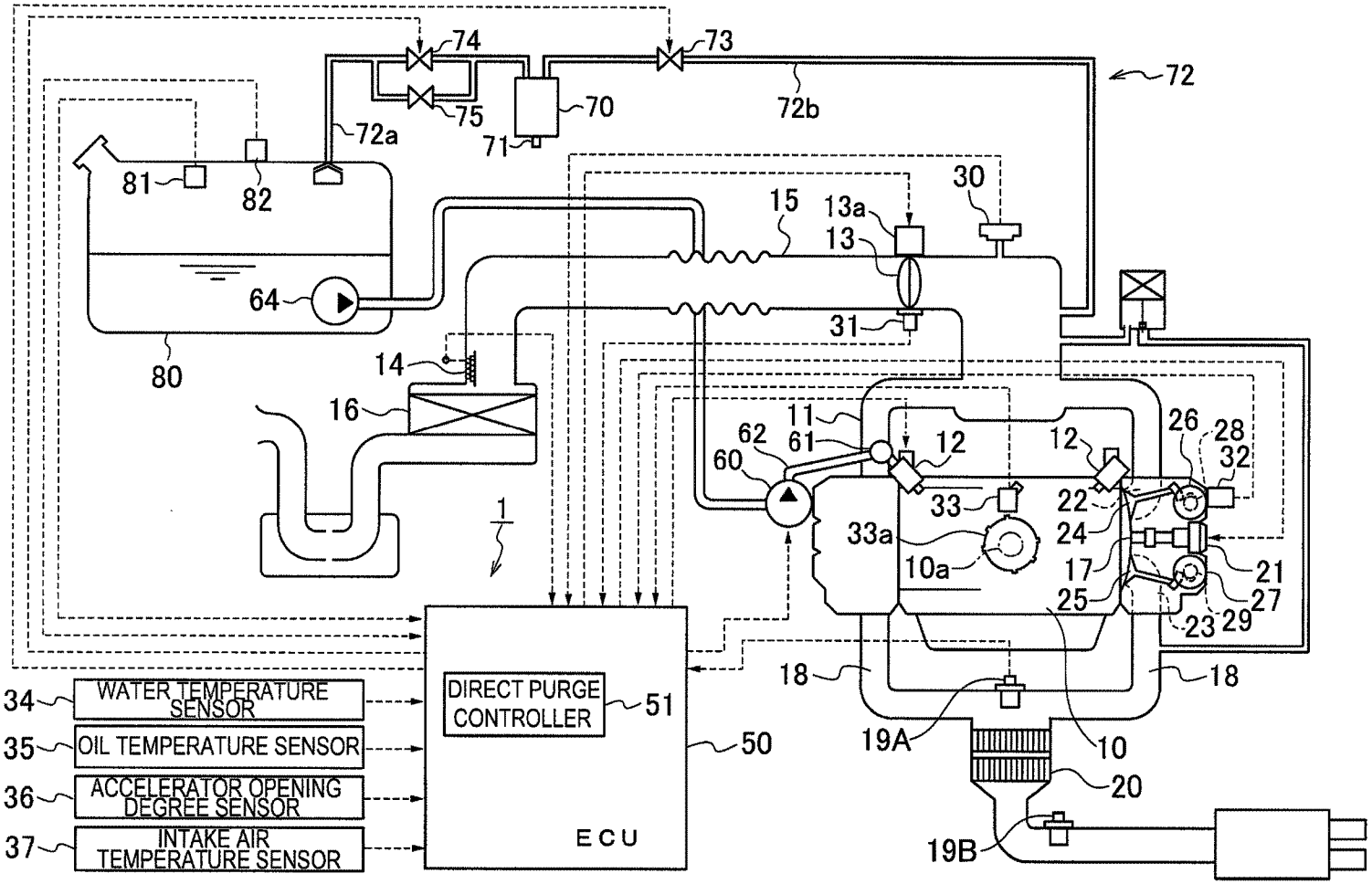
FIG. 1 is a drawing of an evaporated fuel processing apparatus according to an implementation of the present invention and an engine provided with the evaporated fuel processing apparatus.

Referring now to the drawings, a preferred implementation of the present invention will be described in detail. In the drawings, the same or corresponding portions are denoted by the same reference numerals. In the respective drawings, the same elements are designated by the same reference numerals and overlapping description will be omitted.

Referring now to FIG. 1, an evaporated fuel processing apparatus 1 according to an implementation of the present invention will be described. FIG. 1 is a drawing of the evaporated fuel processing apparatus 1 according to the implementation of the present invention and an engine 10 provided with the evaporated fuel processing apparatus 1.

The engine 10 may be, for example, a horizontal opposed four-cylinder gasoline engine. The engine 10 is a cylinder injection engine which injects fuel directly into cylinders. In the engine 10, air sucked from an air cleaner 16 is throttled by an electronically controlled throttle valve (hereinafter, referred to simply as a "throttle valve") 13 provided in an intake pipe 15, passes through an intake manifold 11, and is sucked into the cylinders of the engine 10. An amount of air sucked from the air cleaner 16 (the amount of air sucked into the engine 10) is detected by an air flow meter 14 disposed between the air cleaner 16 and the throttle valve 13. A vacuum sensor 30 that detects the pressure in the intake manifold 11 (an intake manifold pressure) is disposed in a collector (surge tank), which constitutes part of the intake manifold 11. In addition, a throttle opening sensor 31 is disposed in the throttle valve 13 and detects an opening degree of the throttle valve 13.

A cylinder head includes an intake port 22 and an exhaust port 23 for each cylinder (only half a bank is illustrated in FIG. 1). Each intake port 22 includes an intake valve 24 that opens and closes the intake port 22, and each exhaust port 23 includes an exhaust valve 25 that opens and closes the exhaust port 23. A variable valve timing mechanism 26 is disposed between an intake cam shaft 28 and an intake cam pulley that drive the intake valve 24. The variable valve timing mechanism 26 advances and delays a valve timing (opening and closing timing) of the intake valve 24 in a way such that a rotation phase (displacement angle) of the intake cam shaft 28 with respect to a crank shaft 10*a* is continuously changed by rotating the intake cam pulley and the intake cam shaft 28 relatively with each other. The variable valve timing mechanism 26 functions to variably set the opening and closing timing of the intake valve 24 in accordance with an operating state of the engine.

In the same manner, a variable valve timing mechanism 27 is disposed between an exhaust cam shaft 29 and an exhaust cam pulley. The variable valve timing mechanism 27 advances and delays a valve timing (opening and closing timing) of the exhaust valve 25 in a way such that a rotation phase (displacement angle) of the exhaust cam shaft 29 with respect to the crank shaft 10*a* is continuously changed by rotating the exhaust cam pulley and the exhaust cam shaft 29 relatively with each other. The variable valve timing mechanism 27 functions to variably set the opening and closing timing of the exhaust valve 25 in accordance with the operating state of the engine.

Each cylinder of the engine 10 includes an injector 12 that injects fuel into the cylinder. The injector 12 directly injects fuel pressurized by a high-pressure fuel pump 60 into a combustion chamber of each cylinder.

The injector 12 is coupled to a delivery pipe (common rail) 61. The delivery pipe 61 distributes fuel pumped from the high-pressure fuel pump 60 through a fuel pipe 62 to the respective injectors 12. The high-pressure fuel pump 60 increases a pressure of fuel pumped up from a fuel tank 80 by a feed pump (low-pressure fuel pump) 64 to a high pressure (for example, 8 to 13 MPa) in accordance with the operating state and supplies the fuel to the delivery pipe 61. In this implementation of the present invention, the high-pressure fuel pump 60 is of a type driven by the cam shaft 28 of the engine 10.

The cylinder head of each cylinder includes an ignition plug 17 that ignites an air-fuel mixture, and an igniter-integrated coil 21 that applies a high voltage to the ignition plug 17. In each cylinder of the engine 10, the air-fuel mixture including sucked air and fuel injected by the injector 12 is ignited by the ignition plug 17 and burned. Exhaust gas after combustion is emitted through an exhaust pipe 18.

The exhaust pipe 18 includes an air-fuel ratio sensor 19A that outputs a signal in accordance with an oxygen concentration in the exhaust gas. In one implementation of the present invention, the air-fuel ratio sensor 19A may serve as an air-fuel ratio detector. The air-fuel ratio sensor 19A may be a linear air-fuel ratio sensor (LAF sensor) that linearly detects an exhaust air-fuel ratio. The air-fuel ratio sensor 19A may be an $O_2$ sensor that detects the exhaust air-fuel ratio between ON and OFF.

An exhaust air purification catalyst (CAT) 20 is disposed at downstream of the air-fuel ratio sensor 19A, and the exhaust air purification catalyst 20 may be made of a three-way catalyst. The exhaust air purification catalyst 20 oxidizes carbon hydrate (HC) and carbon monoxide (CO) in exhaust gas and reduces nitrogen oxide (NOx) simultaneously, so that harmful gas components in the exhaust gas is purified into harmless carbon dioxide ($CO_2$), moisture vapor ($H_2O$), and nitrogen ($N_2$). A rear (after CAT) $O_2$ sensor 19B that detects an exhaust air-fuel ratio between ON and OFF is provided at downstream of the exhaust air purification catalyst 20.

The fuel tank 80 that stores fuel to be supplied to the engine 10 (injector 12) is a sealed fuel tank, and has pressure resistance so that the evaporated fuel generated in the fuel tank 80 is temporarily trapped. A purge pipe 72 is provided in an upper space of the fuel tank 80. The purge pipe 72 communicates the upper space with the intake manifold 11 of the engine 10, and delivers the evaporated fuel trapped temporarily within the fuel tank 80 to the intake manifold 11 of the engine 10. In one implementation of the present invention, the intake manifold 11 may serve as an "inlet system".

The purge pipe 72 includes a first purge pipe 72*a* that communicates the fuel tank 80 with a canister 70 (described later in detail), and a second purge pipe 72*b* that communicates the canister 70 with the intake manifold 11.

The first purge pipe 72*a* includes an electromagnetic valve 74 that opens and closes the first purge pipe 72*a*. In one implementation of the present invention, the electromagnetic valve 74 may serve as an electromagnetic valve. The electromagnetic valve 74 is a normally closed electromagnetic valve that opens only when electricity is distributed, and closes when the ignition is off (IG OFF). The opening-closing control of the electromagnetic valve 74 is performed by an engine control unit (hereinafter, referred to as ECU) 50 described later.

The first purge pipe 72*a* includes a mechanical relief valve 75 in parallel with the electromagnetic valve 74 so as to bypass the electromagnetic valve 74. The mechanical relief valve 75 is a spring-type mechanical valve, and opens when the pressure (internal pressure) in the fuel tank 80 is increased to a preset pressure or higher to release the high-pressure evaporated fuel to the canister 70.

The canister 70 includes an adsorptive agent such as active carbon therein, which temporarily adsorbs the evaporated fuel within the fuel tank 80 at the time of fueling, for example. The canister 70 is provided with an atmospheric air port 71 that introduces outside air. A space of an upper layer in the canister 70 communicates with the intake manifold 11 via the second purge pipe 72*b*. The second purge pipe 72*b* (that is, on the downstream side of the canister 70) is provided with a variable flow rate electromagnetic valve (hereinafter, referred to also as "purge solenoid valve") 73 regulated in opening degree by the ECU 50.

When the purge solenoid valve 73 is opened and a negative pressure in the intake manifold 11 acts on the second purge pipe 72*b* of the canister 70, air is introduced from the atmospheric air port 71 into the canister 70, and the evaporated fuel adsorbed on active carbon or the like in the canister 70 is released. The released evaporated fuel is sucked into the intake manifold 11 of the engine 10 through the second purge pipe 72*b* together with air introduced from the atmospheric air port 71. The evaporated fuel sucked into the intake manifold 11 is burned and processed in the cylinders of the engine 10.

As described above, the ECU 50 controls opening and closing of the purge solenoid valve 73 and the electromagnetic valve 74. Although detailed description is given later, the ECU 50 has a direct-purge function that cooperatively controls the purge solenoid valve 73 and the electromagnetic valve 74, for instance, opens the electromagnetic valve 74 when the purge solenoid valve 73 is opened, so that the evaporated fuel in the sealed fuel tank 80 is burned and processed by being sucked directly into the engine 10 without being adsorbed in the canister 70.

However, when the internal pressure in the fuel tank 80 is high at the time of fueling, high pressure evaporated fuel may be spouted out from a fill opening (fuel lid). Accordingly, when the fact that the fuel port is opened is detected, the ECU 50 opens the electromagnetic valve 74 and emits the evaporated fuel in the fuel tank 80 into the canister 70. Therefore, a fuel lid sensor (not illustrated) that detects opening and closing of the fill opening is provided at the fuel port. The fuel port also includes a fuel lid lock solenoid that locks the fill opening.

The fuel tank 80 also includes an HC sensor 81 that detects the concentration of the evaporated fuel in the fuel tank 80 at an upper space therein. In one implementation, the HC sensor 81 functions as a concentration detecting unit described in the appended claims. The HC sensor 81 may be, for example, of a contact combustion type or of a type using a change in sound velocity in detection gas. The HC sensor 81 is coupled to the ECU 50, and the ECU 50 receives the detection signal of the HC sensor 81.

The fuel tank 80 includes a tank internal pressure sensor 82 that detects a pressure (internal pressure) in the fuel tank 80. In one implementation, the tank internal pressure sensor 82 functions as a tank internal pressure detector described in the appended claims. The tank internal pressure sensor 82 is also coupled to the ECU 50 and the ECU 50 receives a detection signal from the tank internal pressure sensor 82.

In addition to the air flow meter 14, the LAF sensor 19A, the $O_2$ sensor 19B, the vacuum sensor 30, the throttle opening sensor 31, the HC sensor 81, and the tank internal pressure sensor 82, a cam angle sensor 32 that identifies cylinders of the engine 10 is provided in the vicinity of the cam shaft of the engine 10. A crank angle sensor 33 that detects the rotational position of the crankshaft 10*a* is provided in the vicinity of the crankshaft 10*a* of the engine 10. For example, a timing rotor 33*a* having thirty-four projecting teeth disposed at 10 degrees intervals with two teeth missing is provided at an end of the crankshaft 10*a*, so that the crank angle sensor 33 detects the rotational position of the crankshaft 10*a* by detecting the presence or absence of the projection of the timing rotor 33*a*. The cam angel sensor 32 and the crank angle sensor 33 may be, for example, of an electromagnetic pickup type.

These sensors are coupled to the ECU 50. In addition, various types of sensors including a water temperature sensor 34 that detects temperatures of cooling water of the engine 10, an oil temperature sensor 35 that detects temperatures of lubricant, an accelerator opening degree sensor 36 that detects a pedaling amount of an accelerator, that is, an opening degree (amount of operation) of an accelerator pedal, and an intake air temperature sensor 37 that detects temperatures of intake air are also coupled to the ECU 50.

The ECU 50 includes a microprocessor that executes operations, a ROM that memorizes programs and the like that causes the microprocessor to execute various processes, a RAM that memorizes various data such as results of operations, a backup RAM that retains memorized contents by a battery, and an input output I/F. The ECU 50 also includes an injector driver that drives the injector 12, an output circuit that outputs an ignition signal, and a motor driver that drives the electronically controlled throttle valve 13 (an electric motor 13*a*). In addition, the ECU 50 further includes drivers that drive the purge solenoid valve 73 and the electromagnetic valve 74.

The ECU 50 identifies cylinders on the basis of outputs from the cam angle sensor 32, and obtains an engine speed based on outputs from the crank angle sensor 33. The ECU 50 obtains various items of information such as intake air masses, negative pressures in the intake pipe, opening degrees of the accelerator pedal, air-fuel ratios of the air-fuel mixture, intake air temperatures, evaporated fuel concentration, internal pressures of the fuel tank, water temperatures and oil temperatures of the engine 10 based on detection signals received from the various sensors described above. The ECU 50 controls the engine 10 in a comprehensive manner by controlling the amount of fuel injection, timing of ignition, and various types of devices such as the throttle valve 13, the purge solenoid valve 73, and the electromagnetic valve 74 based on the obtained various items of information.

In particular, the ECU 50 has a function to decrease the internal pressure of the fuel tank in an earlier stage while reducing variations in air-fuel ratio (A/F) of the air-fuel mixture when executing direct purge that causes the evaporated fuel in the sealed fuel tank 80 to be sucked directly into the engine 10 without being adsorbed into the canister 70. Therefore, the ECU 50 functionally includes a direct purge controller 51. The ECU 50 implements the function of the direct purge controller 51 by executing programs memorized in the ROM by the microprocessor.

The direct purge controller 51 performs control to open and close the electromagnetic valve 74 based on the operating state of the engine 10. In other words, in one implementation, the direct purge controller 51 functions as a controller described in the appended claims. More specifically, the direct purge controller 51 executes direct purge by opening the electromagnetic valve 74. For instance, the direct purge is executed under conditions: a variation value of the air-fuel ratio (A/F) is lower than the predetermined value (e.g. the air-fuel ratio is stable); the purge solenoid valve 73 opens (e.g. a normal purge operation that causes the evaporated fuel to be sucked from the canister 70 into the engine 10 is in operation); the pressure in the fuel tank 80 is not lower than a predetermined pressure (e.g. a positive pressure); and a variation value of the pressure in the fuel tank 80 is lower than a predetermined value.

Accordingly, the direct purge controller 51 prohibits the electromagnetic valve 74 from opening under conditions; the variation value of the air-fuel ratio (A/F) is not lower than the predetermined value; the purge solenoid valve 73 is closed (e.g. when the normal purge operation is not in operation); the pressure in the fuel tank 80 is lower than the predetermined value (e.g. a negative pressure,); or the variation value of the pressure in the fuel tank 80 is not lower than the predetermined value. The normal purge operation excludes a case of test driving of the purge solenoid valve 73 for malfunction diagnosis (OBD).

The direct purge controller 51 controls the valve-open cycle of the electromagnetic valve 74 based on the variation value of the air-fuel ratio (A/F) when executing the direct purge, that is, when opening the electromagnetic valve 74.

More specifically, in the case where the variation value of the air-fuel ratio is lower than the predetermined value the direct purge controller 51 shortens the valve-open cycle of the electromagnetic valve 74 compared with a case where the variation value of the air-fuel ratio is not lower than the predetermined value. The direct purge controller 51 may control the valve-open period and the valve-open amount (opening degree) instead of, or in addition to, the valve-open cycle.

The direct purge controller 51 determines the valve-open period of the electromagnetic valve 74 based on, for example, the pressure in the fuel tank 80 and the flow rate of the evaporated fuel flowing in the purge pipe 72 sucked into the engine 10, that is, a purge flow rate. The purge flow rate may be calculated based on, for example, the diameter of the purge pipe 72 as well as the internal pressure of the fuel tank and the intake manifold pressure.

How to determine the valve-open period of the electromagnetic valve 74 will be described below. For example, the ROM of the ECU 50 memorizes a map in which a relation among the purge flow rate (g/s), the internal pressure (kPa) of the fuel tank and the valve-open period (ms) (a valve-open period map) is specified, so that the valve-open period of the electromagnetic valve 74 is obtained by searching the valve-open period map based on the internal pressure of the fuel tank and the purge flow rate.

Figure 2:
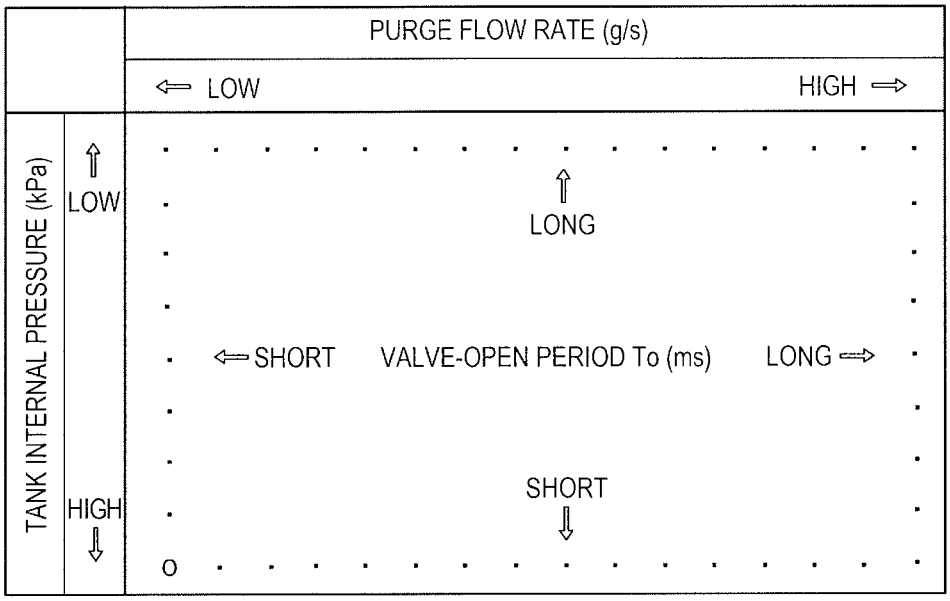
FIG. 2 is a drawing of an example of a valve-open period map.

FIG. 2 illustrates an example of the valve-open period map. In FIG. 2, a lateral axis represents the purge flow rate (g/s), and a vertical axis represents the internal pressure (kPa) of the fuel tank. The valve-open period map provides every combination between the purge flow rate and the internal pressure of the fuel tank (every lattice point) with a valve-open period (ms). The valve-open period map is set so that the valve-open period increases with an increase in purge flow rate. The valve-open period map is also set so that the valve-open period reduces with an increase in internal pressure of the fuel tank.

The direct purge controller 51 may regulate the valve-open cycle and the valve-open period of the electromagnetic valve 74 considering the concentration of the evaporated fuel. In this case, the direct purge controller 51 may correct a threshold value (predetermined value described above) for the determination of the variations in the above-described air-fuel ratio (A/F) and may correct the valve-open period of the electromagnetic valve 74, that is, the map value in accordance with the concentration of the evaporated fuel.

More specifically, the direct purge controller 51 may increase the threshold value (predetermined value described above) that determines variations in air-fuel ratio may be increased, or the valve-open period of the electromagnetic valve 74 may be shortened with an increase of the concentration of the evaporated fuel. The direct purge controller 51 may regulate the valve-open amount (opening degree) instead of, or in addition to, the valve-open period and the valve-open cycle. In this case, the direct purge controller 51 regulates the valve-open amount (opening degree), so that the valve-open amount decreases with an increase in concentration of the evaporated fuel.

Figure 3:
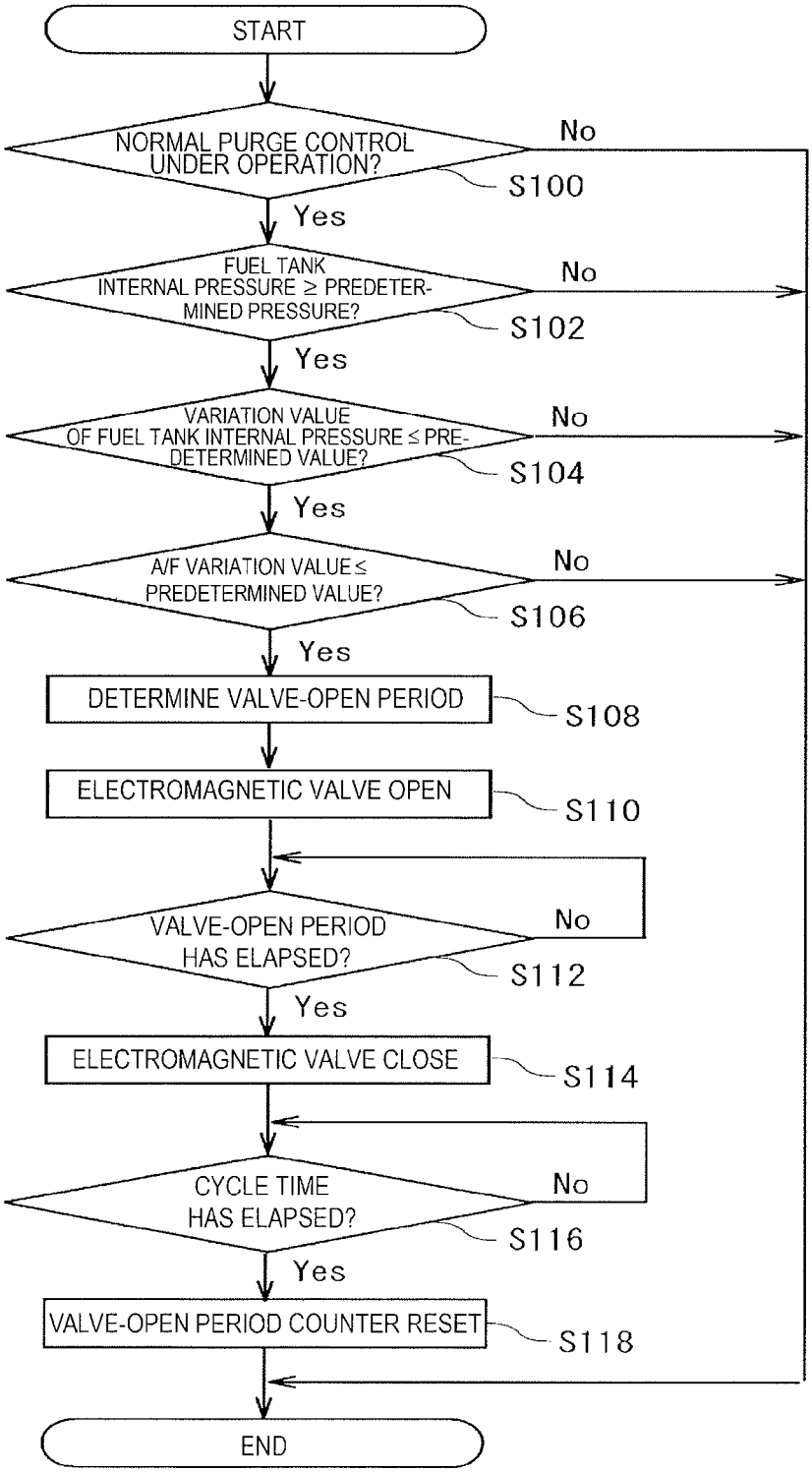
FIG. 3 is a flowchart of a process procedure of an evaporated fuel process (direct purge control) performed by the evaporated fuel processing apparatus according to the implementation of the present invention.
Figure 4:
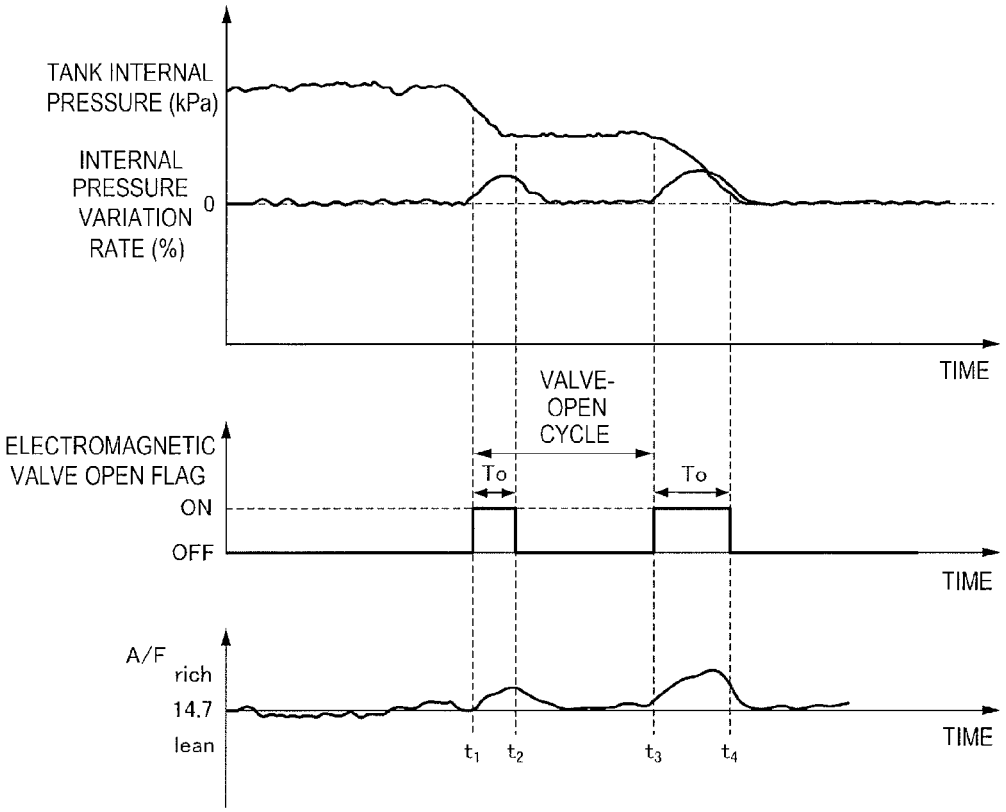
FIG. 4 is a timing chart of an example of changes in tank internal pressure, a tank internal pressure variation rate, an electromagnetic valve open flag, and an air-fuel ratio (A/F) when the evaporated fuel process (direct purge control) is in operation.

Referring now to FIG. 3 and FIG. 4 as well, an operation of the evaporated fuel processing apparatus 1 will be described. FIG. 3 is a flowchart of a process procedure of an evaporated fuel process (direct purge control) performed by the evaporated fuel processing apparatus 1. This process is repeatedly executed by the ECU 50 at predetermined timing. FIG. 4 is a timing chart of an example of changes of the tank internal pressure, the fuel tank internal pressure variation rate, the electromagnetic valve open flag, and the air-fuel ratio (A/F) when the evaporated fuel process (direct purge control) is executed. In FIG. 4, the lateral axis represents time of day, and the vertical axis represents, from the top, the fuel tank internal pressure (kPa), the tank internal pressure variation rate (%), an electromagnetic valve open flag (ON/OFF), and the air-fuel ratio (A/F) in this order.

In Step S100, whether or not the purge solenoid valve 73 is opened, that is, whether or not the normal purge control is in operation is determined. Where the purge solenoid valve 73 is closed, that is, where the normal purge control is not in operation, the procedure goes out of the process. In contrast, when the purge solenoid valve 73 is opened (when the normal purge control is in operation), the procedure goes to Step S102.

In Step S102, whether or not a smoothed value of the internal pressure of the fuel tank is not lower than a predetermined value (for example, positive pressure) is determined. A smoothed value pftsm (kPa) of the internal pressure of the fuel tank may be obtained by the following expression (1):

$$pftsm = pftsm_{n-1} + (ftps - pftsm_{n-1}) \times kSMPFT \quad (1)$$

where ftps is the internal pressure of the fuel tank, that is, a sensor value, kSMPFT is a smoothed coefficient (≤1).

In the case where the internal pressure of the fuel tank is lower than the predetermined value, the procedure goes out from this process. In contrast, when the internal pressure of the fuel tank is not lower than the predetermined value, the process goes to Step S104.

In Step S104, whether or not the variation value of the internal pressure of the fuel tank is within the predetermined value is determined. The variation value dpftsm (kPa) of the internal pressure of the fuel tank may be obtained by the following expression (2):

$$dpftsm = abs(ftps - pftsm) \times kDPFTSM \quad (2)$$

where kDPFTSM is a smoothed coefficient (≤1)

In the case where the variation value of the internal pressure of the fuel tank is higher than the predetermined value, the procedure goes out from this process. In contrast, when the variation value of the internal pressure of the fuel tank is within the predetermined value, the process goes to Step S106.

In Step S106, whether or not the variation value of the air-fuel ratio (A/F) is within the predetermined value is determined. The A/F variation value (A/F feedback variation value) rtausm1 may be obtained by the following expression (3):

$$rtausm1^* = rtausm1^*_{n-1} + (rtau^*n - rtausm1^*n - 1) \times kNRTAU1 \quad (3)$$

where rtau*n is the air-fuel ratio (value of this time), kNRTAU1 is the smoothed coefficient (≤1).

In the case where the variation value of the air-fuel ratio is higher than the predetermined value, the procedure goes out from this process. In contrast, when the variation value of the air-fuel ratio is within the predetermined value, the process goes to Step S108.

In Step S108, the valve-open period To(ms) of the electromagnetic valve 74 is determined based on a purge flow rate (g/s) and the smoothed value of the internal pressure of the fuel tank (kPa). How to determine the valve-open period To of the electromagnetic valve 74 is as described above, so that the detailed description will be omitted here.

Next, in Step S110, the electromagnetic valve 74 is opened, and the pressure in the fuel tank 80 is released (see time t1, t3 in FIG. 4). In Step S110, a count-up of a valve-open period counter that counts the valve-open period is started.

Subsequently, in Step S112, whether or not the valve-open period To of the electromagnetic valve 74 has elapsed is determined based on the value of the valve-open period counter. When the valve-open period To has not elapsed, this process is repeatedly executed until the valve-open period To elapses. In contrast, when the valve-open period To has elapsed, the procedure goes to Step S114.

In Step S114, the electromagnetic valve 74 is closed (see time t2, t4 in FIG. 4). Subsequently, in Step S116, whether or not a predetermined cycle (time) of the electromagnetic valve 74 under hardware constraints has elapsed is determined based on the valve-open period counter. When the predetermined cycle (time) has not elapsed, this process is repeatedly executed until the valve-open cycle (time) elapses. In contrast, when the predetermined cycle (time) has elapsed, the procedure goes to Step S118.

In Step S118, the valve-open period counter is reset (set to zero). Then the procedure goes out from this process.

As described thus far in detail, according to the implementation of the present invention, when the electromagnetic valve 74 opens based on the operating state of the engine 10 (the valve-open conditions of the electromagnetic valve 74 are satisfied), the valve-open cycle, the valve-open period, and/or the valve-open amount of the electromagnetic valve 74 are controlled based on the variation value of the air-fuel ratio (A/F). Therefore, in the operating state in which variations in air-fuel ratio can be reduced, the direct purge controller 51 is allowed to positively open the electromagnetic valve 74. In that case, the direct purge controller 51 is allowed to regulate the amount of the evaporated fuel, which is sucked into the engine 10 via the purge pipe 72, so that the variations in air-fuel ratio do not increase. Consequently, the internal pressure of the fuel tank 80 is allowed to be lowered in an earlier stage while reducing variations in air-fuel ratio of the air-fuel mixture.

According to the implementation of the present invention, the electromagnetic valve 74 is prohibited from closing in the case where the variation value of the air-fuel ratio (A/F) is not lower than the predetermined value, and thus increase in variations in air-fuel ratio may be reduced.

According to the implementation of the present invention, in the case where the variation value of the air-fuel ratio is lower than the predetermined value, the valve-open cycle of the electromagnetic valve 74 is decreased, and thus the internal pressure of the fuel tank 80 may be reduced in an early stage without increasing variations in air-fuel ratio.

According to the implementation of the present invention, the valve-open period of the electromagnetic valve 74 is determined based on the internal pressure of the fuel tank 80 and the flow rate or a purge flow rate of the evaporated fuel that flows in the purge pipe 72 or sucked into the engine 10. This enables the engine 10 to adequately regulate the amount of the evaporated fuel sucked the engine 10.

According to the implementation of the present invention, since the electromagnetic valve 74 is prohibited from opening when the purge solenoid valve 73 is closed, the evaporated fuel trapped in the fuel tank 80 is prevented from being adsorbed in the canister 70. Therefore, prevention of discharge of excessive evaporated fuel which cannot be adsorbed by the canister 70 into an environment and an increase in size of the canister 70 is enabled.

According to the implementation of the present invention, the electromagnetic valve 74 is prohibited from opening when the internal pressure in the fuel tank 80 is lower than the predetermined pressure (for example, negative pressure). Accordingly, determination of necessity of the purge and prevention of the reverse flow of the evaporated fuel are enabled.

In particular, according to the implementation of the present invention, the electromagnetic valve 74 is prohibited from opening when the variation value of the internal pressure in the fuel tank 80 is not lower than the predetermined pressure. Accordingly, adequate determination of necessity of purge and reliable prevention of a reverse flow of the evaporated fuel are enabled.

According to the implementation of the present invention, the valve-open cycle, the valve-open period, and/or the valve-open amount of the electromagnetic valve 74 are regulated considering the concentration of the evaporated fuel. Accordingly, reduction in the internal pressure of the fuel tank 80 in an early stage is enabled while reducing variations in air-fuel ratio further adequately.

The implementations of the present invention have been described thus far, the present invention is not limited to the implementations described above, and various modifications may be made. For example, the HC sensor 81 is used for detecting the concentration of the evaporated fuel. However, for example, the concentration of the evaporated fuel may be estimated from an amount of correction of an air-fuel ratio feedback performed when the evaporated fuel is actually purged instead of the HC sensor 81. Alternatively, for example, the concentration of the evaporated fuel may be obtained by an operation based on the internal pressure, a temperature, a remaining fuel amount, and a capacity of the fuel tank 80.

In the implementations described above, the case where the present invention is applied to the cylinder injection engine has been described as an example. However, the present invention may be applied also to a port injection engine. In the same manner, according to the implementations described above, the present invention is applied to a gasoline engine vehicle. However, the present invention may be applied also to HEVs (hybrid electric vehicles) and PHEVs (plug-in hybrid electric vehicles).

The invention claimed is:

1. An evaporated fuel processing apparatus comprising:
- a fuel tank to store fuel to be supplied to an engine;
- a purge pipe that communicates an upper space in the fuel tank with an inlet system of the engine;
- an electromagnetic valve that is mounted on the purge pipe and that opens and closes the purge pipe;
- an air-fuel ratio detector to detect an air-fuel ratio of an air-fuel mixture burned in the engine in accordance with an oxygen concentration in exhaust gas emitted from the engine; and
- a controller to open or close the electromagnetic valve based on a valve-open cycle, a valve-open period specified by at least internal pressure of the fuel tank and a purge flow rate of evaporated fuel flowing in the purge pipe to the engine, and a valve-open amount of the electromagnetic valve when opening the electromagnetic valve, wherein
- the controller is configured to
  - calculate a rate of change of the air-fuel ratio, and
  - change at least the valve-open cycle and the valve-open period according to the rate of change of the air-fuel ratio by prohibiting the electromagnetic valve from opening when the rate of change of the air-fuel ratio is equal to or greater than a first predetermined value.

2. The evaporated fuel processing apparatus according to claim 1, wherein the controller is configured to shorten the valve-open cycle of the electromagnetic valve when the rate of change of the air-fuel ratio is lower than the first predetermined value.

3. The evaporated fuel processing apparatus according to claim 1, further comprising:
- a tank internal pressure detector to detect the internal pressure in the fuel tank wherein
- the controller is configured to set the valve-open period of the electromagnetic valve based on the internal pressure in the fuel tank detected by the tank internal pressure detector and the flow rate of evaporated fuel flowing in the purge pipe.

4. The evaporated fuel processing apparatus according to claim 1, further comprising:
- a canister mounted on the purge pipe on a downstream side of the electromagnetic valve for adsorbing the evaporated fuel, and
- a purge solenoid valve mounted on the purge pipe on a downstream side of the canister to open and close the purge pipe, wherein
- the controller is configured to prohibit the electromagnetic valve from opening in a case where the purge solenoid valve is closed.

5. The evaporated fuel processing apparatus according to claim 1, wherein the controller is configured to prohibit the electromagnetic valve from opening when the internal pressure in the fuel tank is lower than a predetermined pressure.

6. The evaporated fuel processing apparatus according to claim 5, wherein the controller is configured to prohibit the electromagnetic valve from opening when a variation value of the internal pressure in the fuel tank is equal to or greater than a second predetermined value.

7. The evaporated fuel processing apparatus according to claim 1, further comprising:
- a concentration detector to detect a concentration of the evaporated fuel in the fuel tank, wherein
- the controller is configured to regulate at least one of the valve-open cycle, the valve-open period, and the valve-open amount of the electromagnetic valve based on the concentration of the evaporated fuel detected by the concentration detector.

8. An evaporated fuel processing apparatus comprising:
- a fuel tank to store fuel supplied to an engine;
- a purge pipe that communicates an upper space in the fuel tank with an inlet system of the engine;
- an electromagnetic valve that is mounted on the purge pipe and that opens and closes the purge pipe;
- an air-fuel ratio detector configured to detect an air-fuel ratio of an air-fuel mixture burned in the engine in accordance with an oxygen concentration in exhaust gas emitted from the engine; and
- circuitry configured to open or close the electromagnetic valve based on a valve-open cycle, a valve-open period specified by at least internal pressure of the fuel tank and a purge flow rate of evaporated fuel flowing in the purge pipe to the engine, and a valve-open amount of the electromagnetic valve when opening the electromagnetic valve, wherein
- the circuitry is configured to
  - calculate a rate of change of the air-fuel ratio, and
  - change at least the valve-open cycle and the valve-open period according to the rate of change of the air-fuel ratio by prohibiting the electromagnetic valve from opening when the rate of change of the air-fuel ratio is equal to or greater than a first predetermined value.

9. The evaporated fuel processing apparatus according to claim 8, wherein the circuitry is configured to shorten the valve-open cycle of the electromagnetic valve when the rate of change of the air-fuel ratio is lower than the first predetermined value.

10. The evaporated fuel processing apparatus according to claim 8, further comprising:

a tank internal pressure detector to detect the internal pressure in the fuel tank wherein the circuitry is configured to set the valve-open period of the electromagnetic valve based on the internal pressure in the fuel tank detected by the tank internal pressure detector and the flow rate of evaporated fuel flowing in the purge pipe.

11. The evaporated fuel processing apparatus according to claim 8, further comprising:

a canister mounted on the purge pipe on a downstream side of the electromagnetic valve for adsorbing the evaporated fuel, and a purge solenoid valve mounted on the purge pipe on a downstream side of the canister to open and close the purge pipe, wherein the circuitry is configured to prohibit the electromagnetic valve from opening in a case where the purge solenoid valve is closed.

12. The evaporated fuel processing apparatus according to claim 8, wherein the circuitry is configured to prohibit the electromagnetic valve from opening when the internal pressure in the fuel tank is lower than a predetermined pressure.

13. The evaporated fuel processing apparatus according to claim 12, wherein the circuitry is configured to prohibit the electromagnetic valve from opening when a variation value of the internal pressure in the fuel tank is equal to or greater than a second predetermined value.

14. The evaporated fuel processing apparatus according to claim 8, further comprising:

a concentration detector to detect a concentration of the evaporated fuel in the fuel tank, wherein the circuitry is configured to regulate at least one of the valve-open cycle, the valve-open period, and the valve-open amount of the electromagnetic valve based on the concentration of the evaporated fuel detected by the concentration detector.

* * * * *